US007448114B2

(12) United States Patent
Basham et al.

(10) Patent No.: US 7,448,114 B2
(45) Date of Patent: Nov. 11, 2008

(54) FLOOR SWEEPING AND SCRUBBING MACHINE

(75) Inventors: Michael T. Basham, Maple Grove, MN (US); Warren L. Larson, Maple Grove, MN (US); Terence A. Peterson, deceased, late of Plymouth MN (US); by Barbara J. Peterson, legal representative, Plymouth, MN (US); Richard W. Wellens, Plymouth, MN (US); Mark J. Fleigle, Maple Grove, MN (US); Don Durenberger, Dayton, MN (US); Brent Hayden, Brooklyn Park, MN (US); Ron Lehman, Rogers, MN (US)

(73) Assignee: Tennant Company, Minneapolis, MN (US)

( * ) Notice: Subject to any disclaimer, the term of this patent is extended or adjusted under 35 U.S.C. 154(b) by 133 days.

(21) Appl. No.: 11/418,493

(22) Filed: May 4, 2006

(65) Prior Publication Data

US 2006/0282975 A1 Dec. 21, 2006

Related U.S. Application Data

(60) Provisional application No. 60/678,049, filed on May 5, 2005.

(51) Int. Cl.
*A47L 11/30* (2006.01)
*E01H 1/08* (2006.01)
*A47L 7/00* (2006.01)

(52) U.S. Cl. ..... 15/320; 15/340.4

(58) Field of Classification Search ..... 15/320, 15/340.4, 349, 352, 50.3

See application file for complete search history.

(56) References Cited

U.S. PATENT DOCUMENTS 2,563,151 A 8/1951 Bjorksten ..... 134/111

(Continued)

FOREIGN PATENT DOCUMENTS

DE 44 13 783 A1 3/1995

(Continued)

OTHER PUBLICATIONS

International Search Report for International Applic. No. PCT/US2006/017231 filed May 4, 2006. Date of Mailing: Sep. 25, 2006.

(Continued)

*Primary Examiner*—David B Thomas
(74) *Attorney, Agent, or Firm*—Westman, Champlin & Kelly, P.A.

(57) ABSTRACT

A hard floor sweeping and scrubbing machine includes a mobile body comprising a frame supported on wheels for travel over a surface, a motorized cleaning head, a waste hopper, a hopper lift and a vacuum squeegee. The motorized cleaning head is attached to the mobile body and is configured to perform sweeping and scrubbing operations on the surface. The waste hopper is positioned on a rear side of the cleaning head and is configured to receive waste discharged from the cleaning head during the surface sweeping operations. The hopper lift is configured to raise the waste hopper from an operating position, in which the waste hopper is positioned adjacent the cleaning head, to a dumping position, in which the waste hopper is positioned to dump waste collected in the waste hopper. In one embodiment, the vacuum squeegee is attached to the hopper lift. Also disclosed is a method of cleaning a surface using embodiments of the machine.

19 Claims, 7 Drawing Sheets

U.S. PATENT DOCUMENTS

| | | | | | |
|---|---|---|---|---|---|
| 2,731,659 | A | | 1/1956 | Coplen | 15/320 |
| 2,993,494 | A | | 7/1961 | Svensson | 134/169 |
| 3,037,887 | A | | 6/1962 | Brenner et al. | 134/22 |
| 3,078,190 | A | | 2/1963 | Blaser et al. | 134/10 |
| 3,162,427 | A | | 12/1964 | Knudson et al. | 259/4 |
| 3,197,798 | A | * | 8/1965 | Brown et al. | 15/320 |
| 3,212,762 | A | | 10/1965 | Carroll et al. | 261/124 |
| 3,231,134 | A | | 1/1966 | Webster | 222/1 |
| 3,392,418 | A | | 7/1968 | Schowalter | 15/320 |
| 3,436,262 | A | | 4/1969 | Crowe et al. | 134/10 |
| 3,453,678 | A | | 7/1969 | Gehman et al. | 15/50 |
| 3,456,279 | A | | 7/1969 | Koland | 15/320 |
| 3,460,717 | A | | 8/1969 | Thomas | 15/320 |
| 3,490,948 | A | | 1/1970 | Farison | 134/36 |
| 3,535,162 | A | | 10/1970 | Bray et al. | 134/42 |
| 3,549,420 | A | | 12/1970 | Cunningham | 134/22 |
| 3,604,051 | A | * | 9/1971 | Wendel et al. | 15/340.4 |
| 3,655,096 | A | | 4/1972 | Easter | 222/82 |
| 3,676,889 | A | | 7/1972 | Edlin | 15/320 |
| 3,761,987 | A | | 10/1973 | Nayfa et al. | 15/50 |
| 3,761,988 | A | | 10/1973 | Overton | 15/83 |
| 3,774,262 | A | | 11/1973 | Anthony et al. | 15/322 |
| 3,789,449 | A | | 2/1974 | MacFarland et al. | 15/4 |
| 3,823,727 | A | | 7/1974 | Fry | 137/88 |
| 3,931,662 | A | | 1/1976 | Nayfa et al. | 15/320 |
| 3,938,212 | A | | 2/1976 | Krier et al. | 15/50 |
| 3,940,826 | A | | 3/1976 | Phillips et al. | 15/320 |
| 3,942,218 | A | | 3/1976 | Krier et al. | 15/340 |
| 3,974,541 | A | | 8/1976 | Silvis et al. | 15/320 |
| 3,979,789 | A | | 9/1976 | Peabody et al. | 15/349 |
| 4,000,536 | A | | 1/1977 | Nayfa et al. | 15/50 |
| 4,014,808 | A | | 3/1977 | Herpers, Jr. et al. | 252/135 |
| 4,032,307 | A | | 6/1977 | Sommerfeld | 55/96 |
| 4,037,289 | A | | 7/1977 | Dojan | 15/320 |
| 4,041,567 | A | | 8/1977 | Burgoon | 15/320 |
| D245,994 | S | | 10/1977 | Olson | D23/162 |
| 4,061,001 | A | | 12/1977 | Von der Eltz et al. | 68/200 |
| 4,096,084 | A | | 6/1978 | Thomsen et al. | 252/173 |
| 4,099,285 | A | | 7/1978 | Christensen et al. | 15/83 |
| 4,107,075 | A | | 8/1978 | Kramer | 252/359 |
| 4,133,773 | A | | 1/1979 | Simmons | 252/359 |
| 4,138,756 | A | | 2/1979 | Krier et al. | 15/83 |
| RE29,957 | E | | 4/1979 | Kasper | 15/83 |
| 4,167,798 | A | | 9/1979 | Kltigl et al. | 15/320 |
| 4,167,799 | A | | 9/1979 | Webb | 15/320 |
| 4,173,056 | A | | 11/1979 | Geyer | 15/320 |
| 4,191,590 | A | | 3/1980 | Sundheim | 134/21 |
| 4,194,263 | A | | 3/1980 | Herpers et al. | 15/353 |
| 4,206,530 | A | | 6/1980 | Kroll et al. | 15/340 |
| 4,210,978 | A | | 7/1980 | Johnson et al. | 15/320 |
| D257,845 | S | | 1/1981 | Peabody et al. | D15/50 |
| 4,250,592 | A | | 2/1981 | Emrick | 15/320 |
| 4,258,451 | A | | 3/1981 | Sommerfeld | 15/352 |
| 4,262,382 | A | | 4/1981 | Brown et al. | 15/49 |
| 4,295,244 | A | | 10/1981 | Herpers et al. | 15/320 |
| 4,310,944 | A | | 1/1982 | Kroll et al. | 15/346 |
| 4,320,556 | A | | 3/1982 | Kimzey et al. | 15/347 |
| 4,334,335 | A | | 6/1982 | Brown et al. | 15/319 |
| 4,345,353 | A | | 8/1982 | Sommerfeld | 15/349 |
| 4,346,494 | A | | 8/1982 | Peabody et al. | 15/179 |
| 4,348,783 | A | | 9/1982 | Swanson et al. | 15/320 |
| 4,355,435 | A | | 10/1982 | Kimzey et al. | 15/347 |
| 4,365,189 | A | | 12/1982 | Hawkins et al. | 318/284 |
| 4,369,544 | A | | 1/1983 | Parisi | 15/320 |
| D267,824 | S | | 2/1983 | Mannelly | D32/16 |
| 4,373,227 | A | | 2/1983 | Kimzey et al. | 15/347 |
| 4,377,017 | A | | 3/1983 | Herpers et al. | 15/320 |
| 4,378,855 | A | | 4/1983 | Haub et al. | 180/65 |
| 4,393,538 | A | | 7/1983 | Olson | 15/320 |
| 4,419,141 | A | | 12/1983 | Kunkel | 134/22.12 |
| 4,429,432 | A | | 2/1984 | Copeland et al. | 15/320 |
| D273,620 | S | | 4/1984 | Kimzey et al. | D32/16 |
| D273,621 | S | | 4/1984 | Haub et al. | D32/16 |
| D273,622 | S | | 4/1984 | Brown et al. | D32/16 |
| 4,457,036 | A | | 7/1984 | Carlson et al. | 15/49 |
| 4,511,486 | A | | 4/1985 | Shah | 252/90 |
| 4,557,739 | A | | 12/1985 | Fortman et al. | 55/320 |
| 4,570,856 | A | | 2/1986 | Groth et al. | 239/310 |
| 4,571,771 | A | | 2/1986 | Worwa | 15/319 |
| 4,580,313 | A | | 4/1986 | Blehert | 15/349 |
| 4,586,208 | A | | 5/1986 | Trevarthen | 8/158 |
| 4,595,420 | A | | 6/1986 | Williams, III et al. | 134/6 |
| 4,608,086 | A | | 8/1986 | Dodge | 106/12 |
| 4,615,070 | A | | 10/1986 | Frederick et al. | 15/339 |
| 4,624,026 | A | | 11/1986 | Olson et al. | 15/340 |
| 4,634,403 | A | | 1/1987 | Peabody et al. | 474/1 |
| 4,667,364 | A | | 5/1987 | Meili | 15/320 |
| 4,675,935 | A | | 6/1987 | Kasper et al. | 15/319 |
| 4,676,287 | A | | 6/1987 | Fitzwater | 141/285 |
| 4,676,926 | A | | 6/1987 | Kappler | 252/307 |
| 4,679,271 | A | | 7/1987 | Field et al. | 15/49 |
| 4,709,771 | A | | 12/1987 | Basham et al. | 180/6.5 |
| 4,729,141 | A | | 3/1988 | Berg et al. | 15/49 |
| 4,757,566 | A | | 7/1988 | Field et al. | 15/49 |
| 4,768,311 | A | | 9/1988 | Olson | 51/174 |
| 4,780,243 | A | | 10/1988 | Edgley et al. | 252/307 |
| 4,805,256 | A | | 2/1989 | Mason et al. | 15/320 |
| 4,805,258 | A | | 2/1989 | Sitarski et al. | 15/385 |
| 4,817,233 | A | | 4/1989 | Waldhauser | 15/320 |
| 4,819,676 | A | | 4/1989 | Blehert et al. | 134/21 |
| 4,822,431 | A | | 4/1989 | Bricher et al. | 134/28 |
| 4,838,457 | A | | 6/1989 | Swahl et al. | 222/48 |
| 4,849,027 | A | | 7/1989 | Simmons | 134/22.18 |
| 4,866,804 | A | | 9/1989 | Masbruch et al. | 15/49 |
| 4,881,288 | A | | 11/1989 | May et al. | 15/98 |
| 4,903,718 | A | | 2/1990 | Sullivan | 134/184 |
| 4,913,316 | A | | 4/1990 | Richter | 221/1 |
| 4,967,064 | A | | 10/1990 | Field et al. | 250/203.2 |
| 4,974,618 | A | | 12/1990 | Nysted | 134/21 |
| 4,986,378 | A | | 1/1991 | Kasper | 180/6.48 |
| 4,996,468 | A | | 2/1991 | Field et al. | 318/587 |
| 5,013,333 | A | | 5/1991 | Beaufoy et al. | 55/21 |
| 5,016,310 | A | | 5/1991 | Geyer et al. | 15/49.1 |
| 5,031,837 | A | | 7/1991 | Hanish | 239/267 |
| 5,044,043 | A | | 9/1991 | Basham et al. | 15/319 |
| 5,045,118 | A | | 9/1991 | Mason et al. | 134/21 |
| 5,054,152 | A | * | 10/1991 | Hulicsko | 15/84 |
| 5,060,342 | A | | 10/1991 | Brazier | 15/322 |
| 5,064,010 | A | | 11/1991 | Masbruch et al. | 180/6.5 |
| 5,088,149 | A | | 2/1992 | Berg et al. | 15/322 |
| 5,093,955 | A | | 3/1992 | Blehert et al. | 15/320 |
| RE33,926 | E | | 5/1992 | Waldhauser | 15/320 |
| 5,116,425 | A | | 5/1992 | Ruef | 134/17 |
| 5,133,107 | A | | 7/1992 | MacDonald | 15/50.3 |
| 5,207,642 | A | | 5/1993 | Orkin et al. | 604/65 |
| 5,212,848 | A | | 5/1993 | Geyer | 15/401 |
| 5,213,120 | A | | 5/1993 | Dickson | 134/102.1 |
| 5,231,725 | A | | 8/1993 | Hennessey et al. | 15/83 |
| 5,239,720 | A | * | 8/1993 | Wood et al. | 15/4 |
| 5,244,003 | A | | 9/1993 | Boomgaarden | 137/1 |
| 5,254,146 | A | | 10/1993 | Beaufoy | 55/320 |
| 5,276,933 | A | | 1/1994 | Hennessey et al. | 15/83 |
| 5,295,277 | A | | 3/1994 | Koenigs et al. | 15/83 |
| 5,303,448 | A | | 4/1994 | Hennessey et al. | 15/340.3 |
| 5,319,828 | A | | 6/1994 | Waldhauser et al. | 15/320 |
| 5,331,713 | A | | 7/1994 | Tipton | 15/320 |
| 5,383,605 | A | | 1/1995 | Teague | 239/526 |
| RE35,033 | E | | 9/1995 | Waldhauser | 15/320 |
| 5,455,982 | A | | 10/1995 | Armstrong et al. | 15/320 |
| 5,455,985 | A | | 10/1995 | Hamline et al. | 15/401 |
| 5,462,607 | A | | 10/1995 | Mestetsky et al. | 134/22.12 |
| 5,483,718 | A | | 1/1996 | Blehert et al. | 15/50.3 |
| D369,446 | S | | 4/1996 | Smith | D32/19 |
| 5,509,972 | A | | 4/1996 | Akazawa et al. | 134/26 |

| | | | | |
|---|---|---|---|---|
| 5,515,568 | A | 5/1996 | Larson et al. | 15/50.3 |
| 5,526,547 | A | 6/1996 | Williams et al. | 15/320 |
| 5,535,476 | A | 7/1996 | Kresse et al. | 15/320 |
| 5,566,422 | A | 10/1996 | Geyer | 15/320 |
| 5,593,091 | A | 1/1997 | Harris | 239/127 |
| 5,611,106 | A | 3/1997 | Wulff | 15/320 |
| 5,611,108 | A | 3/1997 | Knowlton et al. | 15/340.4 |
| 5,647,093 | A | 7/1997 | Engel et al. | 15/352 |
| 5,649,643 | A | 7/1997 | Ridgeway | 222/105 |
| 5,659,918 | A | 8/1997 | Anthony et al. | 15/320 |
| 5,659,921 | A | 8/1997 | Narayan | 15/349 |
| 5,711,775 | A | 1/1998 | Field et al. | 55/273 |
| 5,735,017 | A | 4/1998 | Barnes et al. | 15/321 |
| 5,738,248 | A | 4/1998 | Green | 222/129.2 |
| 5,784,755 | A | 7/1998 | Karr et al. | 15/334 |
| 5,802,665 | A | 9/1998 | Knowlton et al. | 15/340.4 |
| 5,813,086 | A | 9/1998 | Ueno et al. | 15/320 |
| 5,816,298 | A | 10/1998 | Stricklin et al. | 141/346 |
| 5,829,094 | A | 11/1998 | Field et al. | 15/352 |
| 5,829,095 | A | 11/1998 | Legatt et al. | 15/412 |
| 5,836,045 | A | 11/1998 | Anthony et al. | 15/320 |
| 5,853,814 | A | 12/1998 | Murphy | 427/434.6 |
| 5,871,152 | A | 2/1999 | Saney | 239/8 |
| 5,884,353 | A | 3/1999 | Berg et al. | 15/83 |
| 5,893,189 | A | 4/1999 | D'Costa | 15/83 |
| 5,901,407 | A | 5/1999 | Boomgaarden | 15/320 |
| 5,940,928 | A | 8/1999 | Erko | 15/319 |
| 5,940,929 | A | 8/1999 | Berg | 15/334 |
| 5,943,724 | A | 8/1999 | Erko et al. | 15/49.1 |
| 5,943,730 | A | 8/1999 | Boomgaarden | 15/320 |
| 5,943,733 | A | 8/1999 | Tagliaferri | 15/340.4 |
| 5,967,747 | A | 10/1999 | Burke et al. | 415/206 |
| 5,983,447 | A | 11/1999 | Boomgaarden | 15/354 |
| 5,991,953 | A | 11/1999 | Durenberger et al. | 15/83 |
| 5,996,173 | A | 12/1999 | Engel et al. | 15/352 |
| 5,996,174 | A | 12/1999 | Boomgaarden et al. | 15/354 |
| 6,003,186 | A | 12/1999 | Larson | 15/82 |
| 6,017,163 | A | 1/2000 | Keppers | 401/48 |
| 6,018,844 | A | 2/2000 | Basham et al. | 15/349 |
| 6,035,479 | A | 3/2000 | Basham et al. | 15/83 |
| 6,041,472 | A | 3/2000 | Kasen et al. | 15/355 |
| 6,070,290 | A * | 6/2000 | Schwarze et al. | 15/340.1 |
| 6,073,295 | A | 6/2000 | Durenberger et al. | 15/83 |
| 6,081,962 | A | 7/2000 | Kasen et al. | 15/353 |
| 6,090,217 | A | 7/2000 | Kittle | 134/11 |
| 6,092,261 | A | 7/2000 | Boomgaarden | 15/323 |
| 6,108,859 | A | 8/2000 | Burgoon | 15/320 |
| 6,117,200 | A | 9/2000 | Berg et al. | 55/287 |
| 6,125,495 | A | 10/2000 | Berg et al. | 15/183 |
| 6,131,766 | A | 10/2000 | King et al. | 222/1 |
| 6,134,744 | A | 10/2000 | Kasen et al. | 15/320 |
| 6,148,476 | A | 11/2000 | Legatt et al. | 15/385 |
| 6,192,542 | B1 | 2/2001 | Frederick et al. | 15/84 |
| 6,192,549 | B1 | 2/2001 | Kasen et al. | 15/337 |
| 6,202,243 | B1 | 3/2001 | Beaufoy et al. | 15/49.1 |
| 6,206,980 | B1 | 3/2001 | Robinson | 134/21 |
| 6,209,756 | B1 | 4/2001 | Van Der Heijden | 222/105 |
| 6,249,926 | B1 | 6/2001 | Wulff | 15/50.1 |
| 6,276,613 | B1 | 8/2001 | Kramer | 239/304 |
| 6,279,196 | B2 | 8/2001 | Kasen et al. | 15/320 |
| 6,283,221 | B2 | 9/2001 | Hurray et al. | 169/30 |
| 6,286,169 | B1 | 9/2001 | D'Costa et al. | 15/52.1 |
| 6,389,641 | B1 | 5/2002 | Boomgaarden et al. | 15/340.1 |
| 6,397,429 | B1 | 6/2002 | Legatt et al. | 15/401 |
| 6,398,829 | B1 | 6/2002 | Shinler et al. | 55/317 |
| 6,401,294 | B2 | 6/2002 | Kasper | 15/320 |
| 6,418,586 | B2 | 7/2002 | Fulghum | 15/320 |
| 6,421,870 | B1 | 7/2002 | Basham et al. | 15/83 |
| 6,425,958 | B1 | 7/2002 | Giddings et al. | 134/21 |
| 6,427,285 | B1 | 8/2002 | Legatt et al. | 15/320 |
| 6,428,590 | B1 | 8/2002 | Lehman et al. | 55/334 |
| 6,442,789 | B1 | 9/2002 | Legatt et al. | 15/320 |
| 6,444,003 | B1 | 9/2002 | Sutcliffe | 55/385.1 |
| 6,449,793 | B2 | 9/2002 | D'Costa et al. | 15/52.1 |
| 6,467,122 | B2 | 10/2002 | Lenkiewicz et al. | 15/320 |
| 6,505,379 | B2 | 1/2003 | Keller | 15/339 |
| 6,507,968 | B1 | 1/2003 | Hansen | 15/49.1 |
| 6,519,808 | B2 | 2/2003 | Legatt et al. | 15/401 |
| 6,523,992 | B1 | 2/2003 | Bublewitz et al. | 366/172.1 |
| 6,530,102 | B1 | 3/2003 | Pierce et al. | 15/52.1 |
| 6,530,117 | B2 | 3/2003 | Peterson | 15/353 |
| 6,543,580 | B1 | 4/2003 | Gathmann et al. | 184/7.4 |
| 6,550,099 | B2 | 4/2003 | Worwag | 15/387 |
| 6,571,423 | B1 | 6/2003 | Lijzenga et al. | 15/385 |
| 6,585,827 | B2 | 7/2003 | Field et al. | 134/6 |
| 6,602,018 | B2 | 8/2003 | Feeny et al. | 403/227 |
| 6,614,195 | B2 | 9/2003 | Bushey et al. | 318/135 |
| 6,618,888 | B2 | 9/2003 | Joynt et al. | 15/49.1 |
| 6,640,386 | B2 | 11/2003 | Morgan et al. | 15/373 |
| 6,647,585 | B1 | 11/2003 | Robinson | 15/322 |
| 6,651,286 | B2 | 11/2003 | Pierce | 15/98 |
| 6,662,402 | B2 | 12/2003 | Giddings et al. | 15/320 |
| 6,662,600 | B1 | 12/2003 | Field et al. | 68/17 |
| D485,175 | S | 1/2004 | Field et al. | D9/432 |
| 6,671,925 | B2 | 1/2004 | Field et al. | 15/320 |
| 6,705,332 | B2 | 3/2004 | Field et al. | 134/102.1 |
| 6,735,811 | B2 | 5/2004 | Field et al. | 15/320 |
| 6,735,812 | B2 | 5/2004 | Hekman et al. | 15/320 |
| 6,742,219 | B2 | 6/2004 | Lenzmeier et al. | 15/345 |
| 6,789,290 | B2 | 9/2004 | Kent et al. | 15/322 |
| 6,795,995 | B1 | 9/2004 | Holbus | 15/97.3 |
| 6,802,098 | B2 | 10/2004 | Geyer et al. | 15/52.1 |
| 6,832,409 | B2 | 12/2004 | Morgan et al. | 15/354 |
| 6,836,919 | B2 | 1/2005 | Shinler | 15/78 |
| 6,842,942 | B2 | 1/2005 | Morgan et al. | 15/414 |
| 6,854,157 | B2 | 2/2005 | Strauser | 15/340.4 |
| 6,877,180 | B2 | 4/2005 | Wilmo et al. | 15/83 |
| 6,893,180 | B2 | 5/2005 | Hall et al. | 401/140 |
| 6,945,261 | B2 | 9/2005 | Wadsworth et al. | 134/95.3 |
| 7,086,118 | B2 * | 8/2006 | Engel et al. | 15/340.4 |
| 7,281,296 | B2 * | 10/2007 | Strauser | 15/348 |
| 2001/0022010 | A1 | 9/2001 | Kasper | 15/320 |
| 2002/0096258 | A1 | 7/2002 | Savas et al. | 156/345.48 |
| 2003/0019071 | A1 | 1/2003 | Field et al. | 15/320 |
| 2003/0029885 | A1 | 2/2003 | Kawolics et al. | 222/105 |
| 2004/0040102 | A1 | 3/2004 | Field et al. | 15/50.1 |
| 2004/0187895 | A1 | 9/2004 | Field et al. | 134/26 |
| 2004/0221407 | A1 | 11/2004 | Field et al. | 15/50.1 |
| 2005/0028316 | A1 * | 2/2005 | Thomas et al. | 15/320 |
| 2005/0193519 | A1 | 9/2005 | Joynt | 15/401 |
| 2005/0217062 | A1 | 10/2005 | Field | 15/320 |
| 2006/0032519 | A1 | 2/2006 | Field | 15/320 |
| 2006/0048331 | A1 | 3/2006 | Rau et al. | 15/340.2 |

FOREIGN PATENT DOCUMENTS

| | | |
|---|---|---|
| EP | 0173394 | 8/1985 |
| EP | 0 744 148 A2 | 11/1996 |
| EP | 1 044 645 A2 | 10/2000 |
| JP | 11216092 | 8/1999 |
| WO | WO 95/09557 | 4/1995 |
| WO | WO 00/35333 | 6/2000 |
| WO | WO 02/05047 | 1/2002 |
| WO | WO 02/06435 | 1/2002 |

OTHER PUBLICATIONS http://www.stolzenberg.de/eng/technik, "The high point in the world of sweeper technology," Techik, 2 pages, May 4, 2005.

http://www.stolzenberg.de/eng/technik, "This revolution in the world of sweeping technology," Technik, 2 pages, May 4, 2005.

Discover Magazine, Jun. 2002, "Does the Universe Exist if We Don't Observe It!", including cover, Table of Contents, and pp. 26 and 27.

Tennant 6200E Operator Manual, 330410, Rev. 08 (Mar. 2006), pp. 1-80.

* cited by examiner

FLOOR SWEEPING AND SCRUBBING MACHINE

CROSS-REFERENCE TO RELATED APPLICATION

The present application is based on and claims the benefit of U.S. provisional patent application Ser. No. 60/678,049, filed May 5, 2005, the content of which is hereby incorporated by reference in its entirety.

FIELD OF THE INVENTION

The present invention generally relates to hard floor surface cleaning machines and, more particularly, to a hard floor cleaning machine configured to perform sweeping and scrubbing operations.

BACKGROUND

Floor cleaning in public, commercial, institutional and industrial buildings have led to the development of various specialized floor sweeping and scrubbing machines. These machines include dedicated floor sweeping machines, dedicated floor scrubbing machines and combination floor sweeping and scrubbing machines.

FIG. 1 is a side view of an example of a dedicated floor sweeper 200 that is described in U.S. Pat. No. 4,571,771, which is assigned to Tennant Company of Minneapolis, Minn. The sweeper 200 includes a rotating cylindrical brush 202 that contacts the floor 204 and throws loose debris into a hopper 206 which is periodically emptied either manually or through a motorized lift.

FIG. 2 is a side view of an example of a dedicated floor scrubber 210 that is described in U.S. Pat. No. 5,016,310, which is assigned to Tennant Company. The floor scrubber 210 applies a cleaning solution from an onboard tank to the floor 212, agitates it with one or more rotating brushes 214 to loosen dirt that is adhered to the floor 212 and suspends it in the cleaning solution to form liquid waste. The liquid waste is then picked up with a vacuum squeegee 216 and stored in an onboard tank 218.

Combination floor sweeping and scrubbing machines were developed to avoid the necessity of having two machines. Some floor sweeping and scrubbing machines were created by mounting sweeping components to the front end of a dedicated scrubbing machine to making one large, multi-function machine. FIG. 3 is a side view of an example of such a machine 220 that is described in U.S. Pat. No. 5,943,724, which is assigned to Tennant Company. The sweeping components, such as a dedicated sweeping brush 222 and a waste hopper 224 are borrowed from a dedicated sweeping machine and handle the sweeping operations on the floor. Scrubbing components of the dedicated scrubbing machine, such as a dedicated scrubbing brush 226, a vacuum squeegee 228, and a cleaning liquid dispenser, handle the scrubbing operations on the floor.

FIG. 4 is a perspective view of a scrubbing machine 230 that is described in U.S. Pat. No. 5,901,407, which is assigned to Tennant Company. The machine 230 uses two counter-rotating cylindrical brushes 232 to simultaneously scrub and sweep the floor. Water and detergent are sprayed on the floor ahead of the brushes to wet the floor for a scrubbing operation. The brushes 232 then scour the floor at the same time they are sweeping debris from the floor and into a waste hopper 234 located on a rear side of the brushes 232. A vacuum squeegee 236 removes liquid waste from the floor during the wet scrubbing and sweeping operations. The machine 230 is not configured to perform sweeping-only operations and the hopper 234, which must be removed manually from the machine for dumping, is not large enough to support pure sweeping operations. As a result, the machine 230 only provides limited sweeping capability requiring the use of a dedicated sweeper prior to performing the scrubbing/sweeping operation using the machine 230.

There exists a continuous demand for improvements to combination floor sweeping and scrubbing machines including, for example, simplifying operation of the machine including waste removal, improving maintenance access to components of the machine, providing features that prevent or reduce the likelihood of damaging the machine, and other improvements.

The discussion above is merely provided for general background information and is not intended to be used as an aid in determining the scope of the claimed subject matter.

SUMMARY

Embodiments of the present invention are generally directed to a hard floor sweeping and scrubbing machine. In one embodiment, the machine includes a mobile body comprising a frame supported on wheels for travel over a surface, a motorized cleaning head, a waste hopper, a hopper lift and a vacuum squeegee. The motorized cleaning head is attached to the mobile body and is configured to perform sweeping and scrubbing operations on the surface. The waste hopper is positioned on a rear side of the cleaning head and is configured to receive waste discharged from the cleaning head during the surface sweeping operations. The hopper lift is configured to raise the waste hopper from an operating position, in which the waste hopper is positioned adjacent the cleaning head, to a dumping position, in which the waste hopper is positioned to dump waste collected in the waste hopper. In one embodiment, the vacuum squeegee is attached to the hopper lift.

Another embodiment of the invention is directed to a method of cleaning a surface using embodiments of the hard floor sweeping and scrubbing machine described above.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 5:
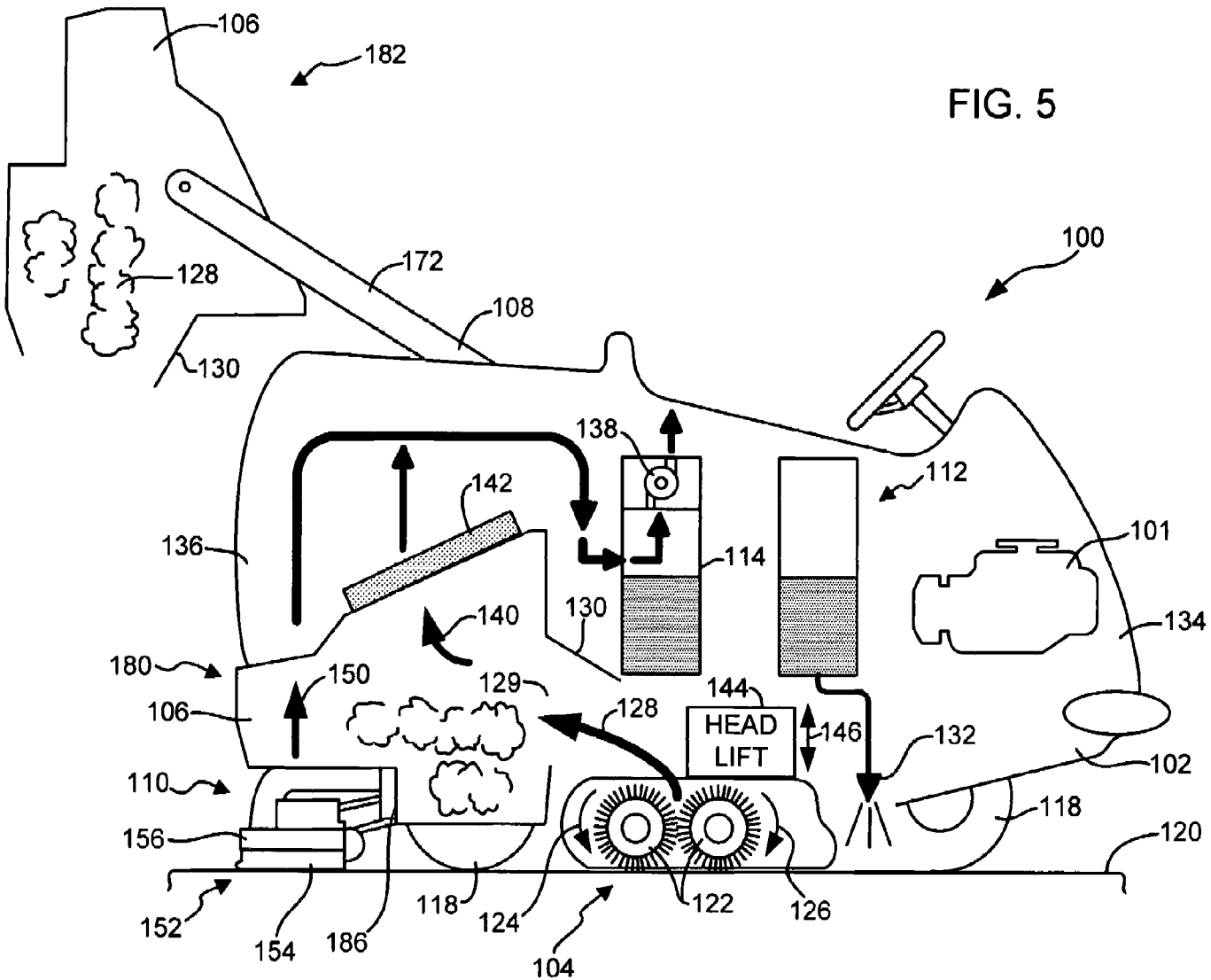
FIG. 5 is a simplified diagram of a sweeping and scrubbing machine in accordance with embodiments of the invention.
Figure 6:
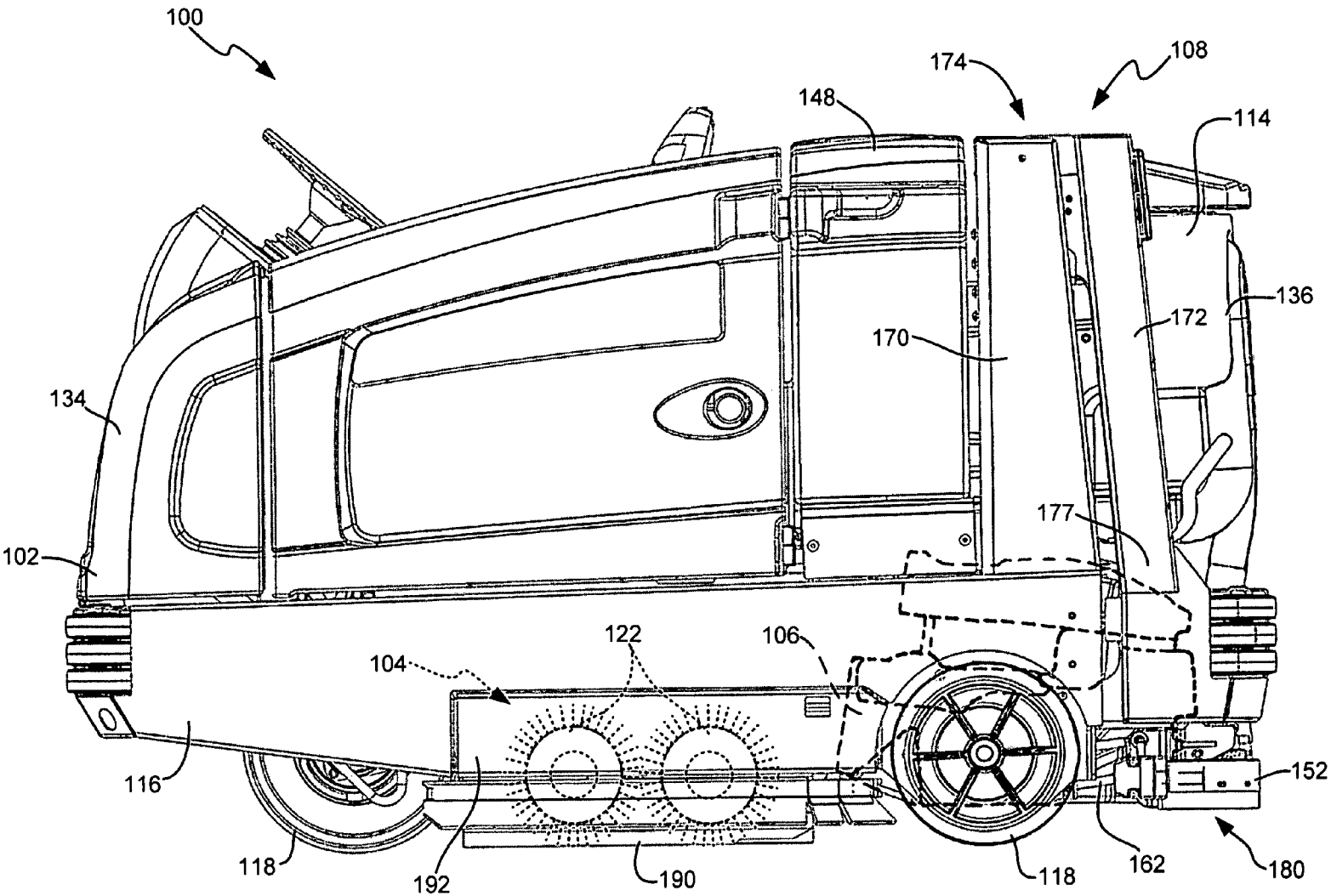
FIG. 6 is a side view of a sweeping and scrubbing machine in accordance with embodiments of the invention.

The present invention is directed to a floor sweeping and scrubbing machine. FIGS. 5 and 6 respectively are a schematic diagram and a side view of a sweeping and scrubbing machine 100 in accordance with embodiments of the invention. Although the machine 100 is depicted as a ride-on machine, the machine 100 may be designed for use by an operator that walks behind the machine, or the machine may be configured to be towed behind a vehicle. The machine 100 may be powered through an on-board power source, such as batteries or an internal combustion engine 101, or powered through an electrical cord.

Embodiments of the machine 100 include components that are supported on a motorized mobile body 102. Such components include, for example, a motorized cleaning head 104, a rear hopper 106, a hopper lift 108, and a fluid recovery system 110. Machine 100 can also include a cleaning liquid or water dispensing system 112, a waste recovery tank 114, and other components.

The mobile body 102 comprises a frame 116 supported on wheels 118 for travel over a surface 120, on which a cleaning operation is to be performed.

The cleaning head 104 can include one or more brushes 122 that are configured for sweeping and scrubbing operations on the surface 120. In accordance with one embodiment of the invention, the cleaning head 104 is configured as a sweep/scrub head that is adapted to perform wet and/or dry sweeping operations, and scrubbing operations on the surface 120.

Figure 1:
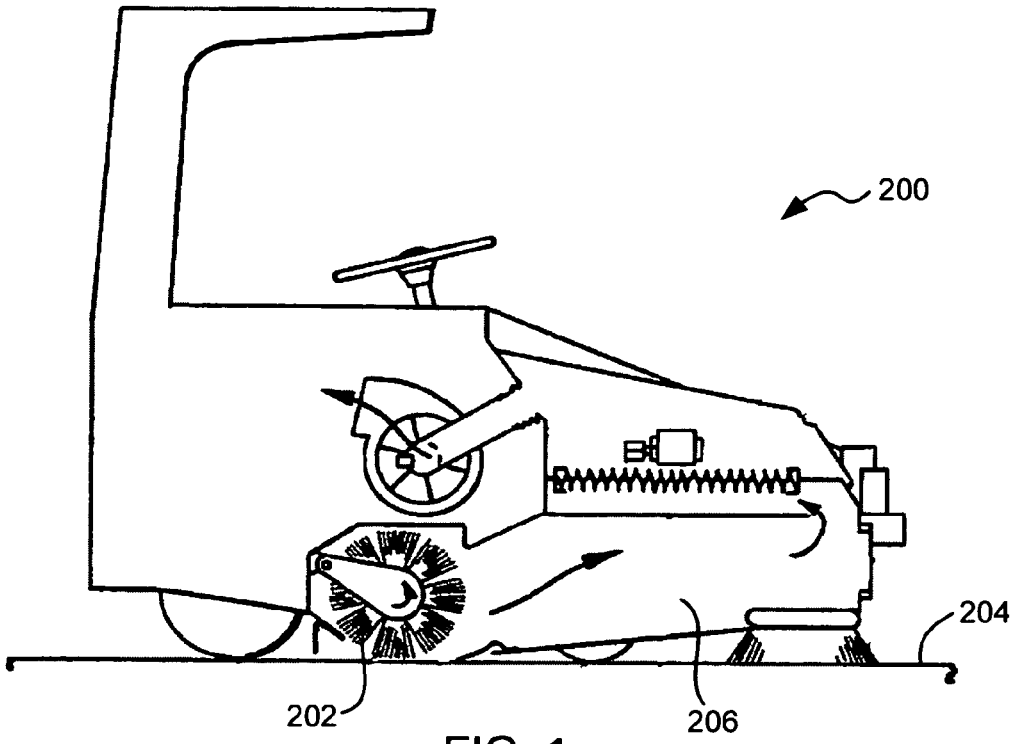
FIG. 1 (PRIOR ART)
FIG. 1 is a side view of a dedicated hard floor sweeper in accordance with the prior art.
Figure 2:
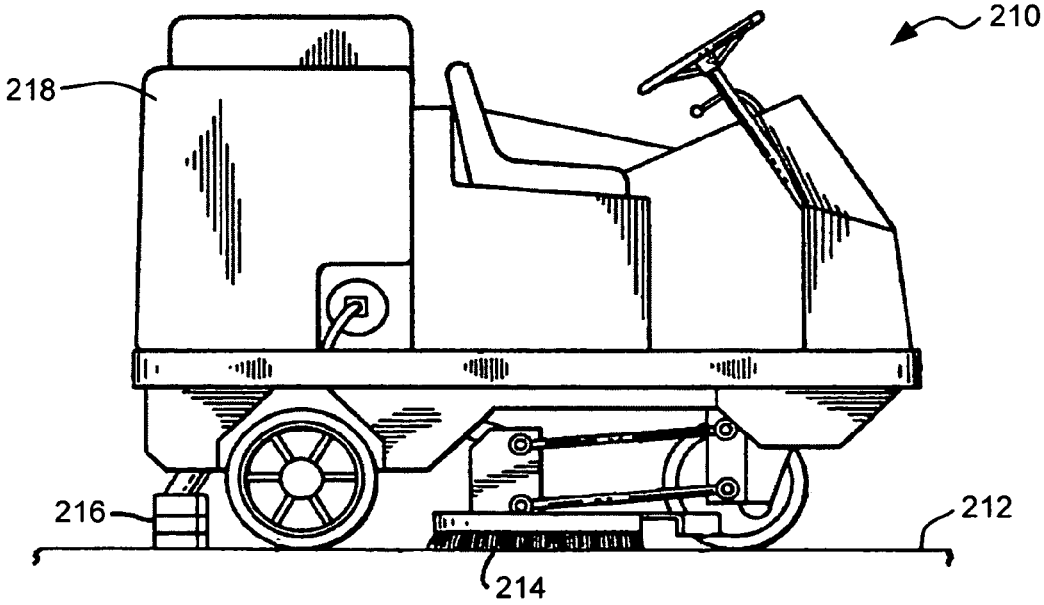
FIG. 2 (PRIOR ART)
FIG. 2 is a side view of a dedicated hard floor scrubber in accordance with the prior art.
Figure 3:
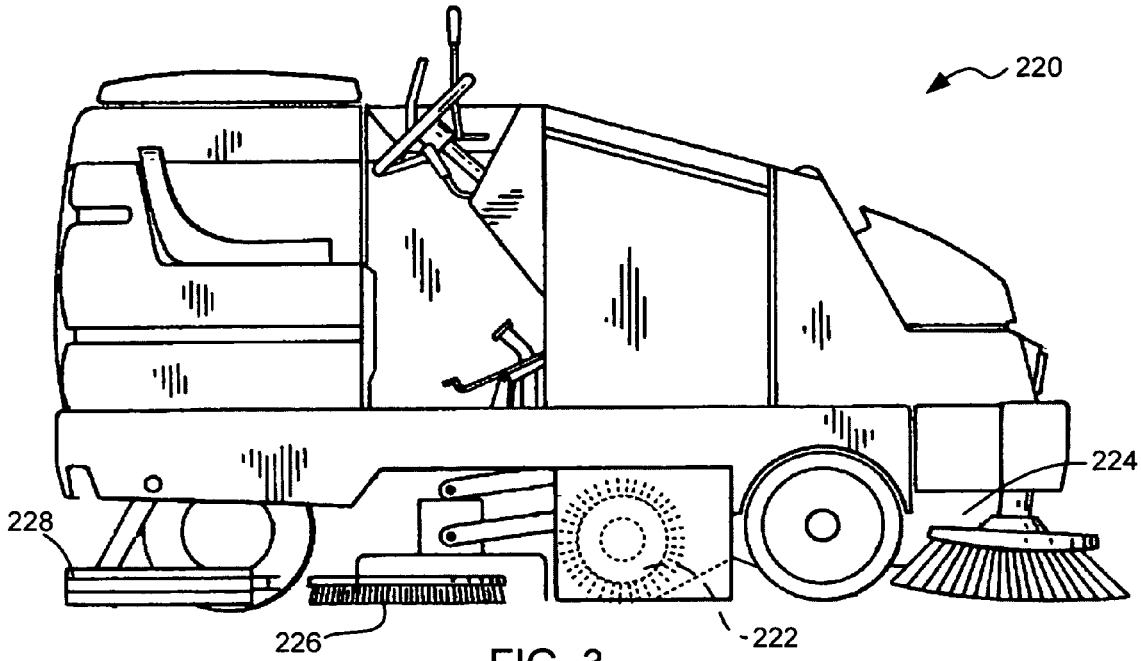
FIG. 3 (PRIOR ART)
FIGS. 3 and 4 respectively are side and perspective views of combination hard floor sweeping and scrubbing machines in accordance with the prior art.
Figure 4:
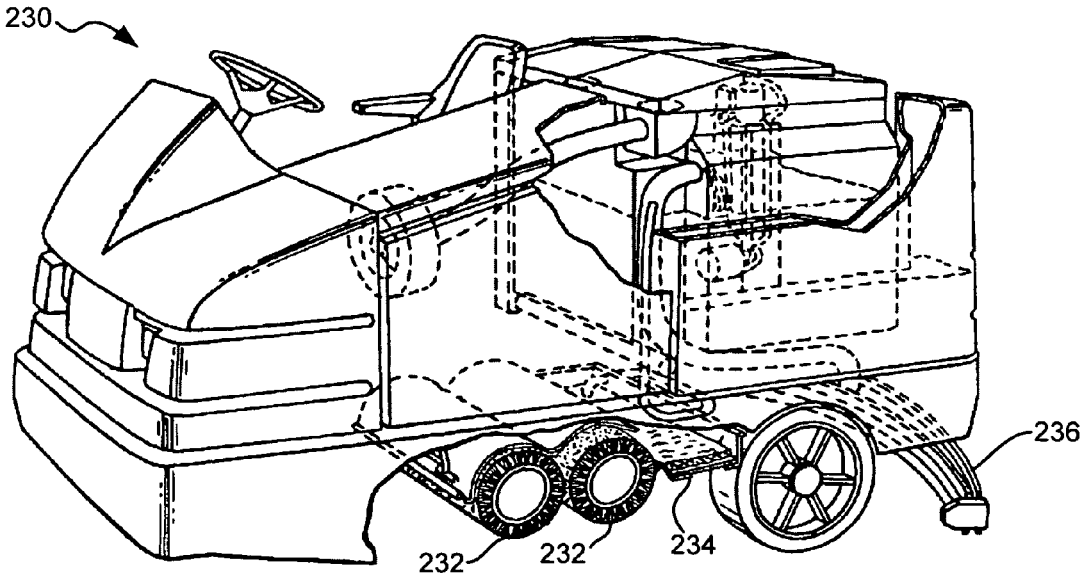
FIG. 4 (PRIOR ART)

One embodiment of the cleaning head 104, shown in FIG. 4 includes scrub/sweep brushes 122 that rotate in opposite directions, as indicated by arrows 124 and 126. One or more motors drive the rotation of the brushes 122. A deflector over the surfaces of the brushes 122 directs waste swept by the brushes 122 into the waste hopper 106, as indicated by arrow 128.

During a dry sweeping operation, waste material 128 is swept by brushes 122 into the rear hopper 106 through an opening 129 that can be covered by a door 130 of the hopper 106. In one embodiment, the machine 100 includes one or more dust control systems to reduce the amount of airborne dust that is generated during such dry sweeping operations.

In accordance with one embodiment of the invention, the dust control system comprises the liquid dispensing system 112, which includes a sprayer 132 on a front side 134 of the head 104 that is opposite a rear side 136 on which the waste hopper 106 is positioned. The liquid dispensing system 112 is configured to spray a dust control liquid, such as water or foam, to the surface 120 during dry sweeping operations. The amount of liquid applied to the surface 120 is much less than that applied during floor scrubbing operations, during which the complete wetting of the surface 120 is desired to remove embedded dirt on the surface 120. Thus, although the surface 120 may be slightly wetted, the sweeping operation is still considered to be a dry sweeping operation. With the surface slightly wetted, the sweeping operation performed by the brushes 122 generates less airborne dust than that which would be generated if the surface 120 was completely dry.

In accordance with another embodiment, the machine 100 includes a vacuumized dust control system. The vacuumized dust control system includes a vacuum fan 138 that is placed in vacuum communication with the waste hopper 106 or the cleaning head 104, and draws airborne dust, indicated by arrow 140, into the machine 100. In one embodiment, the vacuum fan 138 draws the airborne dust through an air filter 142, which traps the dust.

In one embodiment, the machine 100 includes a head lift 144 that is configured to raise and lower the cleaning head 104 relative to the frame 116 of the mobile body 102, as indicated by arrow 146. The head lift 144 can be used to raise the cleaning head 104 off the surface 120 during transport as well as control a pressure applied to the surface 120 during sweeping and scrubbing operations.

Another embodiment of the machine 100, includes skirting around the sides, front and rear of the cleaning head 104. The skirting engages the floor 120 and prevents dust and debris from escaping from the cleaning head 104 during sweeping operations. The skirting is preferably mounted directly to the fixed frame 116 of the machine 100 so that the bottom of the skirting remains in a fixed position relative to the floor regardless of the height of the cleaning head 104. This prevents additional wear on the skirting that would occur if allowed to move toward the floor along with the cleaning head 104 as the brushes of the cleaning head 104 wear, or during a cleaning operations in which the brushes are forced closer to the surface being scrubbed. As a result, a preferred embodiment of the skirting does not move in response to movement of the cleaning head 104. However, another embodiment of the invention includes mounting the skirting to a housing of the cleaning head 104, whereby the skirting moves with the cleaning head 104.

During wet scrubbing and sweeping operations, water or a cleaning liquid contained in a tank 148 is sprayed to the surface 120 in front of the cleaning head 104. The wetted debris on the surface 120 is swept into the waste hopper 106 by the brushes 122 while they also scrub the surface 120. The soiled cleaning liquid is then collected by the fluid recovery system 110 and deposited in the waste recovery tank 114 as indicated by arrow 150.

Figure 7:
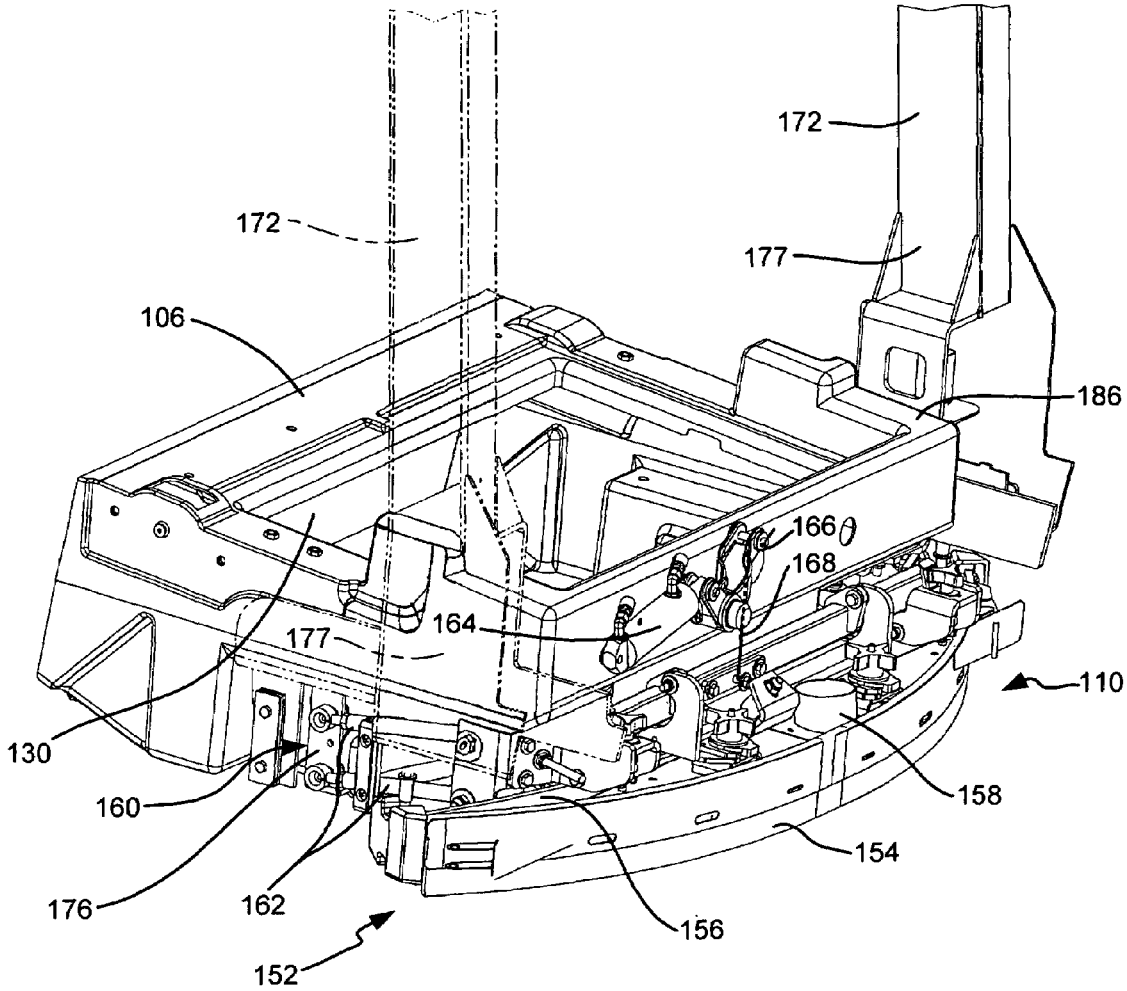
FIG. 7 is a perspective view of a waste hopper and vacuum squeegee in accordance with embodiments of the invention.

One embodiment of the fluid recovery system 110 of the machine 100 includes a vacuum squeegee 152 mounted adjacent the rear end 136 of the machine 100, as shown in FIGS. 5 and 6. The vacuum squeegee 152 generally comprises a squeegee 154 that extends across the width of the machine 100 and a frame 156 that supports the squeegee as shown in FIG. 7. The vacuum squeegee 156 also includes a vacuum port 158 that is placed in vacuum communication with the vacuum fan 138 using conduit or other conventional means. The vacuum fan 138 operates to remove liquid and particle waste, as indicated by arrow 150, collected by the vacuum squeegee 152 for deposit in the waste recovery tank 114.

In one embodiment, the vacuum squeegee 152 includes a squeegee lift 160 that is configured to raise and lower the squeegee 154 small distances relative to the surface 120 during floor cleaning operations. Typically, the squeegee lift 160 is used to raise the squeegee 154 relative to the surface 120 when the machine 100 is traveling backwards or is performing only a sweeping operation on the surface 120. One benefit of using the squeegee lift 160 is that scrubbing operations can be performed on the surface 120 while moving the machine 100 forward and backward across the surface 120.

In one embodiment, the squeegee lift 160 comprises a parallelogram linkage on either side of the vacuum squeegee 152 that connects the frame 156 of the vacuum squeegee 152 to a support frame of the machine 100. One advantage of the parallelogram linkage is that it maintains the squeegee 154 in the desired orientation relative to the surface 120 during movement. A castor wheel or other limiting structure can be provided to limit the low position of the squeegee blade 154 relative to the surface 120. The raising and lowering of the vacuum squeegee 152 using the squeegee lift 160 can be controlled by a lift cylinder 164 that actuates a pivot arm 166 that is connected to the frame 154 to vacuum squeegee 152 through a cable 168.

The cleaning head 104 preferably continuously applies a desired pressure to the surface 120 being swept or scrubbed during cleaning operations. The head lift 144 or other mechanism can be used to control the pressure that is applied to the surface 120 by the cleaning head 104. The operator of the machine 100 can select the desired pressure through a control panel of the machine 100.

In accordance with one embodiment of the invention, multiple scrub pressures (e.g., light, medium and heavy) are used as desired by the operator. Embodiments of the invention include multiple scrub pressure settings in the range of 2.5 to 5.0 lb/in of brush length.

The performance of sweeping operations using the same pressure settings as those used during scrubbing operations would result in significant wear of the scrub brushes 122. This is due to the abrasive debris on the surface 120 even when a small amount of liquid is present. Accordingly, the pressure applied by the cleaning head 104 to the surface 120 during such sweeping operations is preferably less than that used during scrubbing operations. Moreover, high pressures are not required to perform the sweeping operation. In accordance with one embodiment of the invention, the pressure applied during the sweeping operation is within a range of 1.25 to 4.0 lb/inch of brush length, and is preferably less than 1.5 lb/inch of brush length.

The hopper 106 of the machine 100 is positioned to the rear side 136 of the cleaning head 104. The hopper 106 collects wet and dry waste 128 that is discharged through the opening 124 by the cleaning head 104, as discussed above. Liquid can be removed from the hopper 106 through a vacuumized perforated box, a bottom drain, or other process. The hopper 106 is positioned beneath components positioned at the rear 136 of the machine 100, such as the water tank 148, the waste recovery tank 114, and/or other components, as shown in FIG. 6.

Figure 8:
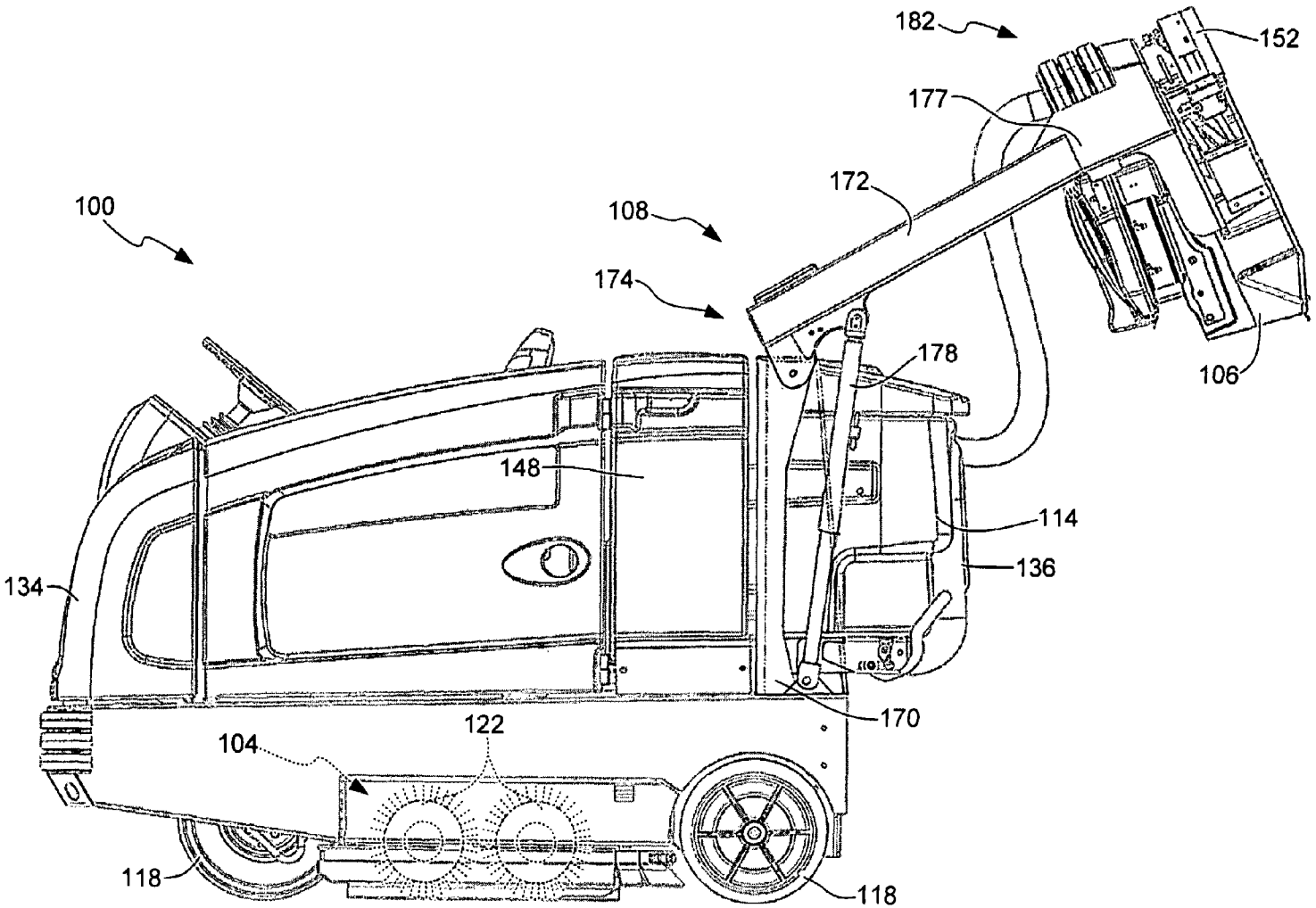
FIG. 8 is a side view of the sweeping and scrubbing machine of FIG. 6 with the waste hopper in a dumping position.

One embodiment of the machine 100 includes the hopper lift 108. One embodiment of the hopper lift 108 includes a pair of lower support members 170 attached to the frame 116 of the mobile body 102, as shown in FIGS. 6 and 8. Extension arms 172 are each connected to one of the lower support members 170 through a hinge 174. The hopper 106 is supported by a frame 176 mounted to a distal end 177 of the extension arms 172. One or more hydraulic actuators 178 drive the extension arms 172 between a waste receiving or operating position 180 (FIGS. 5 and 6), in which the hopper 106 receives the discharge of wet and dry waste 128 swept by the cleaning head 104, and a dumping position 182 (FIGS. 5 and 8), in which the contents of the hopper 106 can be dumped into a waste bin. The door 130 (FIG. 5) seals the opening 129 of the hopper 106 during the lifting process. The door 130 is opened, as shown in FIG. 5, to dump the waste 128 contained therein into a waste bin.

Due to the position of the hopper 106 beneath components of the machine 100, it is necessary to slide the hopper 106 under those components before it can be raised. In accordance with the exemplary embodiment provided herein, the lower support members 170 of the hopper lift 108 are nearly perpendicular to the surface 120 (i.e., angled forward less than 5°) in order to allow the hopper 106 to clear from beneath the components of the machine 100. As a result, gravitational force on hopper 106, when it is near its waste receiving position, is insufficient to secure the hopper 106 in the more forward waste receiving position 180. In accordance with one embodiment of the invention, the hydraulic actuators 178 apply a force to pull the extension arms toward their corresponding support member 170 to move the hopper 106 to the final waste receiving position 180. In accordance with one embodiment of the invention, the hydraulic actuators 178 apply a continuous force to the extension arms 172 to maintain the hopper 106 in the waste receiving position 180 during cleaning operations. Alternatively, a mechanical latch can maintain the hopper 106 in the waste receiving position 180 during cleaning operations In accordance with one embodiment of the invention, the vacuum squeegee 152 is attached to the rear side 186 of the waste hopper 106 or to the hopper lift 108, such that the vacuum squeegee 152 moves with the raising and lowering of the waste hopper 106 by the hopper lift 108. The attachment of the vacuum squeegee 152 to the waste hopper 106 or the hopper lift 108 can be made directly or through one or more intermediary components. Thus, as used herein, the vacuum squeegee 152 is considered "attached" to the waste hopper 106 or the hopper lift 108, when the vacuum squeegee 152 is connected to the waste hopper 106, the supporting structure for the waste hopper 106 (e.g., the frame 176), or a component (e.g., squeegee lift 160) attached to the waste hopper 106, or other component connected to the hopper lift 108. In the exemplary configuration shown in FIG. 7, the vacuum squeegee 152 is attached to the waste hopper 106 and connected to the hopper lift 108 due to the mounting of the vacuum squeegee 152 to the frame 176 of the hopper lift 108 that supports the waste hopper 106.

Accordingly, the vacuum squeegee 152 is considered to be "attached" to the waste hopper 106 or the hopper lift 108 when it is supported by the extension arms 172 or connected to any component supported by the extension arms 172. On the other hand, the vacuum squeegee 152 would not be considered "attached" to the waste hopper 106 or the hopper lift 108, if the vacuum squeegee 152 was supported on the lower support arm 170 side of the hinge 174 of the hopper lift 108, because the vacuum squeegee 152 would not be raised and lowered along with the raising and lowering of the waste hopper 106.

The mounting of the vacuum squeegee 152 to the hopper lift 108 provides several advantages over prior art designs, in which the vacuum squeegee 152 is mounted to the frame 116 of the mobile body 102 and is generally accessible only by pivoting the vacuum squeegee 152 in a horizontal plane. For instance, the vacuum squeegee 152 of the present invention is easily accessed by raising the hopper lift 108 to the dumping position 182 or an intermediate position between the dumping position 182 and the operating position 180. This allows the vacuum squeegee 152 to be inspected, repaired, adjusted, and replaced much more easily than the configurations of the prior art.

Additionally, the vacuum squeegee 152 can be easily raised to avoid obstacles. For example, the loading of prior art cleaners onto a transport vehicle by moving the cleaner up a ramp and onto a bed of the transport vehicle can result in damage to the conventionally mounted squeegee. As a result, the conventionally mounted squeegee must be removed and reinstalled upon arrival to the destination in order to ensure that it is not damaged. While the squeegee lift 160 lacks the desired range of motion needed to raise the vacuum squeegee 152 to a safe height, the hopper lift 108 is capable of raising the vacuum squeegee a foot or more off the ground to avoid any possibility of contact with the bed of the transport vehicle, thereby simplifying the loading of the machine 100.

During a cleaning operation, the vacuum squeegee 152 may catch on something, such as something on the surface 120 To prevent damage of the vacuum squeegee 152, one embodiment of the invention includes applying a fixed holding force by the hopper lift 108 to maintain the hopper 106 in the waste receiving position 180. Upon impact with an object that grabs the hopper 106 or the vacuum squeegee 152, the holding force is released by the hopper lift 108 automatically and the extension arms 172 are allowed to pivot rearwardly about the hinge 174 to avoid damage to the hopper 106, the squeegee 152, and other components of the machine 100. In accordance with one embodiment of the invention, when the holding force is overcome by contact of a component of the machine 100 with an object, as sensed by rearward movement of the extension arms 172 or a component attached to the frame 188 of the hopper lift 108, the holding force is immediately released. Alternatively, sensors can be used to detect shock forces and release the holding force upon reaching a threshold.

Machine 100 can also include side squeegees 190, shown in FIG. 6, that are configured to direct fluid and debris toward the center of the path along which the machine 100 is traveling for pickup by the vacuum squeegee 152. In accordance with one embodiment of the invention, the side squeegees 190 are mounted to side doors 192 of the machine 100 adjacent the cleaning head 104. The side doors 192 are mounted to the frame 116 of the mobile body 102.

Each of the side squeegees 190 can be mounted to the corresponding door 192 with a pair of parallelogram linkages that operate in a similar manner as that described above for the squeegee lift 160. In one embodiment, the raising and lowering of the side squeegee 190 is independent of the raising and lowering of the cleaning head 104. In accordance with one embodiment, the lifting of the vacuum squeegee 152 automatically causes the lifting of the side squeegees 190. Thus, a single input from the operator of the machine 100 to lift the squeegees results in the lifting of all of the squeegees. This can be accomplished through the controls of the machine 100 or by connecting the cables of the squeegees to the same lift cylinder.

The capability of the machine 100 of the present invention to raise and lower the squeegees 190 independent of the cleaning head 104 provides advantages over the prior art. This allows the squeegees 190 to be lowered only during scrubbing operations and raised during sweeping operations, which result in reduced wear of the side squeegees 190. Additionally, since the squeegees 190 are generally designed to engage the surface 120 only when the machine 100 is moving in a forward direction, scrubbing operations with cleaners having the side squeegees mounted to the scrub head are not possible when the cleaner is moving in a rearward direction, since both of the side squeegees and the scrub head must be raised. However, since the side squeegees 190 of the present invention can be raised independently of the position of the cleaning head 104, the cleaning head 104 can be lowered to perform the scrubbing operation while the machine 100 is traveling in a rearward direction and the side and rear squeegees are raised.

One embodiment of the present invention includes a method of performing the scrubbing operation while the squeegees 190 and 152 are in a raised position and while the machine 100 is moving in a rearward direction. The method also includes performing a scrubbing operation while the cleaner is moving in a forward direction with the squeegees raised or lowered. Such a cleaning operation allows the liquid to remain on the floor or surface 120 for a longer period of time (i.e., the fluid recovery system is not immediately used to remove the liquid waste) thereby allowing for more thorough cleaning of the surface 120 when desired.

Figure 9:
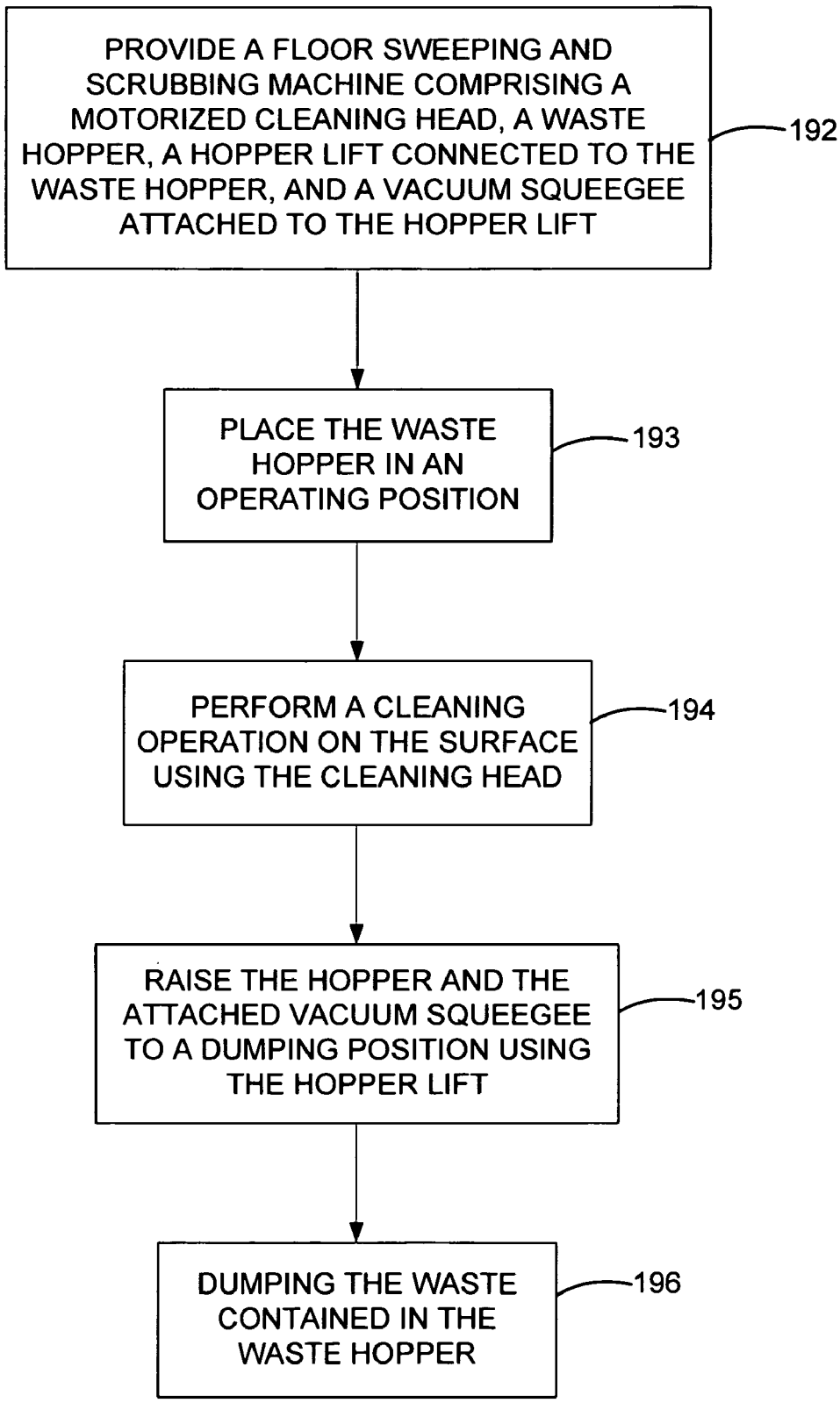
FIG. 9 is a flowchart illustrating a method of cleaning a surface using a sweeping and scrubbing machine in accordance with embodiments of the invention.

FIG. 9 is a flowchart of a method of cleaning a surface in accordance with embodiments of the invention. At step 192 of the method, a scrubbing and sweeping machine 100 in accordance with the embodiments described above is provided. In one embodiment, the machine 100 includes embodiments of the motorized cleaning head 104, the waste hopper 106, the hopper lift 108 and the vacuum squeegee 152 attached to the hopper lift. At step 192, the waste hopper is placed in the operating position 180, in which the waste hopper 106 is positioned adjacent a rear side 136 of the cleaning head 104. Next, at step 193, a cleaning operation is performed on the surface 126 using the cleaning head 104. Embodiments of the cleaning operation include a sweeping and/or scrubbing operation. In accordance with one embodiment, waste 128 is swept into the waste hopper 106 by the cleaning head 104 during the scrubbing operation and liquid waste is removed from the surface 120 using the vacuum squeegee 152. At step 194, the waste hopper 106 and the attached vacuum squeegee 152 are raised to the dumping position 182 using the hopper lift 108. Finally, the waste 128 contained in the waste hopper 106 is dumped at step 195.

In accordance with one embodiment, a lighter pressure is applied to the surface 120 by the cleaning head 104 during the sweeping operation than that applied to the surface 120 during the scrubbing operation.

In accordance with another embodiment of the method, dust is controlled during the sweeping operation by applying a liquid to the surface 120 using the liquid dispenser 112 to dampen the surface 120. In accordance with another embodiment, dust is controlled during the sweeping operation by drawing dust through an air filter 142 using the vacuum fan 138.

Although the present invention has been described with reference to preferred embodiments, workers skilled in the art will recognize that changes may be made in form and detail without departing from the spirit and scope of the invention.

What is claimed is:

1. A floor sweeping and scrubbing machine comprising:

a mobile body comprising a frame supported on wheels for travel over a surface;

a motorized cleaning head attached to the mobile body, the cleaning head configured to perform sweeping and scrubbing operations on the surface;

a waste hopper positioned on a rear side of the cleaning head and configured to receive waste discharged from the cleaning head during the surface sweeping operations;

a hopper lift connected to the mobile body and configured to raise the waste hopper from an operating position, in which the waste hopper is positioned adjacent the cleaning head, to a dumping position, in which the waste hopper is positioned to dump waste collected in the waste hopper;

a vacuum squeegee;

a vacuum fan in vacuum communication with a vacuum port of the vacuum squeegee; and a waste recovery tank supported by the mobile body on the rear side of the cleaning head and configured to receive liquid waste collected by the vacuum squeegee.

2. The machine of claim 1, wherein the vacuum squeegee is attached to the hopper lift, whereby the vacuum squeegee is raised and lowered in response to the raising and lowering of the waste hopper by the hopper lift.

3. The machine of claim 2, wherein the vacuum squeegee comprises a squeegee frame and a squeegee connected to the squeegee frame.

4. The machine of claim 1, wherein:

the cleaning head comprises first and second cylindrical brushes each configured for rotation about a horizontal axis; and the cleaning head is configured to perform dry sweeping operations on the surface and wet sweeping and scrubbing operations on the surface.

5. The cleaner of claim 4, wherein the vacuum squeegee is attached to the hopper lift through a hopper frame supporting the waste hopper.

6. The cleaner of claim 1, further comprising a dust control system including an air filter and a vacuum fan configured to draw dust from the waste hopper through the air filter.

7. The machine of claim 1, wherein the hopper lift comprises a first arm attached to the frame of the mobile body, a second arm supporting the waste hopper and the vacuum squeegee, and a hinge connecting the first and second arms, whereby the second arm pivots about the hinge to move the waste hopper between the operating and dumping positions.

8. A floor sweeping and scrubbing machine comprising:

a mobile body comprising a frame supported on wheels for travel over a surface;

a motorized cleaning head attached to the mobile body and configured to perform sweeping and scrubbing operations on the surface;

a waste hopper positioned on a rear side of the cleaning head and configured to receive liquid and solid waste discharged from the cleaning head during the surface sweeping operations; and a hopper lift connected to the mobile body and configured to raise the waste hopper from an operating position, in which the waste hopper is positioned adjacent the cleaning head, to a dumping position, in which the waste hopper is positioned to dump waste collected in the waste hopper; and a vacuum squeegee attached to the hopper lift, whereby the vacuum squeegee is raised and lowered in response to the raising and lowering of the waste hopper by the hopper lift.

9. The machine of claim 8, wherein the vacuum squeegee is attached to the hopper lift through a hopper frame supporting the waste hopper.

10. The machine of claim 8, further comprising a liquid dispenser positioned on a front side of the cleaning head that is opposite the rear side, the liquid dispenser configured to apply a liquid to the surface.

11. The machine of claim 8, wherein the hopper lift comprises a first arm attached to the frame of the mobile body, a second arm supporting the waste hopper and the vacuum squeegee, and a hinge connecting the first and second arms, whereby the second arm pivots about the hinge to move the waste hopper between the operating and dumping positions.

12. The machine of claim 8, further comprising:

a vacuum fan in vacuum communication with a vacuum port of the vacuum squeegee; and a waste recovery tank supported by the mobile body on the rear side of the cleaning head and configured to receive liquid waste collected by the vacuum squeegee.

13. The cleaner of claim 8, further comprising a dust control system including an air filter and a vacuum fan configured to draw dust from the waste hopper through the air filter.

14. The machine of claim 8, wherein the cleaning head is configured to perform dry sweeping operations on the surface and wet sweeping and scrubbing operations on the surface.

15. The machine of claim 14, wherein the cleaning head comprises first and second cylindrical brushes each configured for rotation about a horizontal axis.

16. A method of cleaning a surface comprising steps of:

providing a floor sweeping and scrubbing machine comprising:

a motorized cleaning head;

a waste hopper;

a hopper lift connected to the waste hopper; and a vacuum squeegee attached to the hopper lift;

placing the waste hopper in an operating position, in which the waste hopper is positioned adjacent a rear side of the cleaning head;

performing a cleaning operation on the surface using the cleaning head including sweeping waste into the waste hopper;

raising the waste hopper and the vacuum squeegee to a dumping position using the hopper lift; and dumping the waste contained in the waste hopper.

17. The method of claim 16, further comprising performing a scrubbing operation on the surface including sweeping waste into the waste hopper using the cleaning head and collecting and removing liquid waste from the surface using the vacuum squeegee.

18. The method of claim 17, further comprising applying a lighter pressure to the surface with the cleaning head during the sweeping operation than that applied during the scrubbing operation.

19. The method of claim 16, further comprising dampening the surface and drawing dust through an air filter during the sweeping operation.

* * * * *